United States Patent [19]

Suzuki et al.

[11] 4,203,873

[45] May 20, 1980

[54] ANIONIC DETERGENT COMPOSITION CONTAINING A BUILDER MIXTURE COMPRISING AN IMIDOBIS-SULFATE AND SODIUM CITRATE OR NITRILOTRIACETATE

[75] Inventors: Hiroshi Suzuki, Mitaka; Yukio Ito, Tokyo; Yosiro Yasumoto, Fuchu; Sigeru Kinomura; Kazuo Nagashima, both of Yokohama, all of Japan

[73] Assignee: Agency of Industrial Science & Technology, Tokyo, Japan

[21] Appl. No.: 936,599

[22] Filed: Aug. 24, 1978

Related U.S. Application Data

[63] Continuation of Ser. No. 753,777, Dec. 23, 1976, abandoned.

[30] Foreign Application Priority Data

Dec. 23, 1975 [JP] Japan ..... 50-153537

[51] Int. Cl.[2] ..... C11D 3/34; C11D 1/12

[52] U.S. Cl. ..... 252/545; 252/546; 252/550; 252/551; 252/555; 252/558

[58] Field of Search ..... 252/135, 527, 545, 546, 252/530, 549, 550, 551, 554, 555, 558; 423/385, 388; 210/23, 180

[56] References Cited

U.S. PATENT DOCUMENTS

| | | | |
|---|---|---|---|
| 4,088,611 | 5/1978 | Suzuki et al. | 252/541 |
| 4,148,742 | 4/1979 | Crutchfield et al. | 252/102 |

*Primary Examiner*—P. E. Willis, Jr.

*Attorney, Agent, or Firm*—Armstrong, Nikaido, Marmelstein & Kubovcik

[57] ABSTRACT

The present invention relates to a detergent composition containing an anionic surface active agent, imidobissulfate of the general formula $$(MSO_3)_2NM$$

(in which M represents cation selected from the group consisting of sodium ion, potassium ion and ammonium ion) and at least one compound selected from the group consisting of sodium nitrilotriacetate and sodium citrate.

5 Claims, 1 Drawing Figure

ANIONIC DETERGENT COMPOSITION CONTAINING A BUILDER MIXTURE COMPRISING AN IMIDOBIS-SULFATE AND SODIUM CITRATE OR NITRILOTRIACETATE

This is a continuation of application Ser. No. 753,777, filed Dec. 23, 1976 now abandoned.

BACKGROUND OF THE INVENTION

The present invention relates to a novel and useful detergent composition for domestic and industrial uses.

Usually, when a surface active agent is used as a main component of detergent, builder is added thereto. Although builder itself has no detergency, it excellently accelerates the detergency of surface active agent due to the chelating effect, dispersing power and other properties of builder.

Heretobefore, there have been known various kinds of compounds as builders. Among them, sodium salts or potassium salts of phosphoric acids such as tripolyphosphoric acid, tetrametaphosphoric acid and pyrophosphoric acid have been widely utilized in view of their excellent efficiency. However, these phosphates have various problems in other points than efficiency.

When waste washing water containing such a builder run into river, lake or sea, phosphorous components result in increasing nutriments of water weeds in water and accelerate the propagation of water weeds. Development of novel builders in place of phosphate type builders has been strongly required in view of environmental conservation. Recently, some kinds of builders other than phosphate type builders have been proposed, however, almost all of them have not yet been commercially utilized in view of efficiency as builder, safety and economical points.

Some of the inventors of the present invention have found and proposed that tri-alkali metal salts and tri-ammonium salt of imidobissulfuric acid are effective as builder in place of phosphates.

These tri-alkali metal salts and tri-ammonium salt of imidobissulfuric acid can be more economically supplied into market in comparison with sodium tripolyphosphate, which is the most conventional builder, and have good efficiency. However, these imidobissulfates are still not enough in chelating property and also in detergency.

As compared with sodium tripolyphosphate, they have to be added in a larger amount in order to show the same detergency as sodium tripolyphosphate. Even when using a larger amount of these imidobissulfates, waste water containing them does not accelerate the propagation of water weeds, but it is not preferable from the economical and other points of view to use a large amount thereof.

The inventors of the present invention have found that when some specific compound is used together with the imidobissulfate, the amount of the imidobissulfate to be added in place of phosphates into detergent composition is remarkably reduced and the detergency is remarkably increased. In other words, the inventors of the present invention attempted to use various conventional chelating agents in combination with the imidobissulfate and found that typical chelating agents such as tetrasodium ethylenediamine-tetraacetate, which has very high chelating property, do not show any substantial effect, but sodium nitrilotriacetate and/or sodium citrate in combination with the imidobissulfate show sharply improved detergency.

OBJECTS OF THE INVENTION

An object of the present invention is to provide a novel detergency composition which essentially needs not any phosphate as a builder component.

Another object of the present invention is to provide a novel detergent composition having improved detergency which contains a compound of the general formula $(MSO_3)_2NM$, which is quite effective especially from the economical and safety points of view, as a main component of builder, and a small amount of other specific compound.

Other objects and advantages of the present invention will become apparent hereinafter.

SUMMARY OF THE INVENTION

The objects of the present invention may be achieved by providing a detergent composition which contains an anionic surface active agent, imidobissulfate of the general formula $$(MSO_3)_2NM$$

in which M represents cation selected from the group consisting of sodium ion, potassium ion and ammonium ion, and at least one compound selected from the group consisting of sodium nitrilotriacetate and sodium citrate. In the above detergent composition, the amount of the anionic surface active agent is preferably 25–65 parts by weight, the amount of the imidobissulfate is preferably 25–65 parts by weight and the amount of sodium nitrilotriacetate and/or sodium citrate is preferably 5–35 parts by weight based on 100 parts by weight of the total of the composition.

DESCRIPTION OF THE PREFERRED EMBODIMENT

The present invention relates to a novel detergent composition in which tri-alkali metal or ammonium imidobissulfate, and sodium nitrilotriacetate and/or sodium citrate are blended with an anionic surface active agent.

Preferable anionic surface active agents to be used in the present invention are easily selected from the conventional anionic surface active agents such as sodium linear-alkyl-benzene-sulfonate, sodium higher-alcohol-sulfate, sodium higher-alcohol-ethoxy-sulfate, sodium olefine-sulfonate and the corresponding potassium or ammonium salts.

On the other hand, in case of using nonionic surface active agent in place of the anionic surface active agent, improvement in detergency can not be attained. For instance, when using nonionic surface active agent obtained by adding 9 moles of ethylene oxide to alcohol of average carbon number 9 in combination with the imidobissulfate and nitrilotriacetate and/or citrate, the detergency is not substantially increased.

In the imidobissulfate of the general formula $(MSO_3)_2NM$, which is a main component of builder, M is a cation selected form $Na^+$, $K^+$and $NH_4^+$.

One of the most preferable imidobissulfates is trisodium imidobissulfate.

The imidobissulfates can be economically prepared by synthesis or exhaust gas treatment using sulfur and ammonia as raw materials and, as clear from the general formula, they have essentially no phosphorus atom in their molecules which frequently cause various environmental pollutions and the contents of nitrogen are also very low.

One of the most important characteristics required for builders is the low toxicity.

Although many of the conventional builders have problems in toxicity, the imidobissulfates show moderate alkaline and water solubility and have substantially no problem in oral toxicity, skin irritation, fish toxicity, solubility to blood and the like.

In the detergent composition of the present invention, (tri)sodium nitrilotriacetate and/or (di)dodium citrate is used in combination with the anionic surface active agent and the imidobissulfate.

The detergent composition of the present invention can also contains other ingradients such as soda ash, anhydrous Glauber's salt, silicate, pollution inhibitor and the like.

In the above detergent composition, the amount of the anionic surface active agent is preferably 25–65 parts, more preferably 30–55 parts, by weight, the amount of the imidobissulfate is preferably 25–65 parts, more preferably 30–60 parts, by weight and the amount of sodium nitrilotriacetate and/or sodium citrate is preferably 5–35 parts, more preferably 5–25 parts, by weight, based on 100 parts by weight of the total of the surface active agent and the builder, respectively.

In the builder mixture of the imidobissulfate and sodium nitrilotriacetate and/or sodium citrate, the amount of sodium nitrilotriacetate and/or sodium citrate is preferably 10–50%, more preferably 10–40%, by weight. The detergent composition of the present invention can be used in the form of powder, liquid and the like. In practical use, the detergent composition is usually dissolved in water or warm water.

As is mentioned above, the detergent composition of the present invention has various advantages in comparison with the conventional detergent compositions and has excellent detergency equal to the detergent compositions containing tripolyphosphate.

EXAMPLES 1, 2 AND COMPARATIVE EXAMPLES 1-7

A standard cotton cloth was soiled with a soil shown in Table 1 by wet method, washed by means of a washing tester "Terg-O-Tometer" for 15 minutes at a room temperature, washed with water for 5 minutes, dehydrated and then dried naturally.

Reflectance of the cotton cloth thus obtained was measured by means of a photoelectric surface reflectance tester of photovolt type, and detergency was calculated from the reflectances before and after washing.

The results are shown in Table 2 and FIG. 1.

The ingradients of detergent composition used above are as follows.

| | |
|---|---|
| Sodium linear-alkylbenzen-sulfonate | 0.25g/l |
| builder (shown in Table 2) | 0.5 g/l |

Water used above is artificial hard water ($CaCO_3$ 100 ppm, Ca:Mg=85:15)

BRIEF DESCRIPTION OF THE DRAWING

In the tables and the drawing, A represents sodium tripolyphosphate, B represents trisodium imidobissulfate, C represents sodium nitrilotriacetate, D represents sodium citrate and E represents tetrasodium ethylenediamine-tetraacetate.

Table 1

Figure 1:
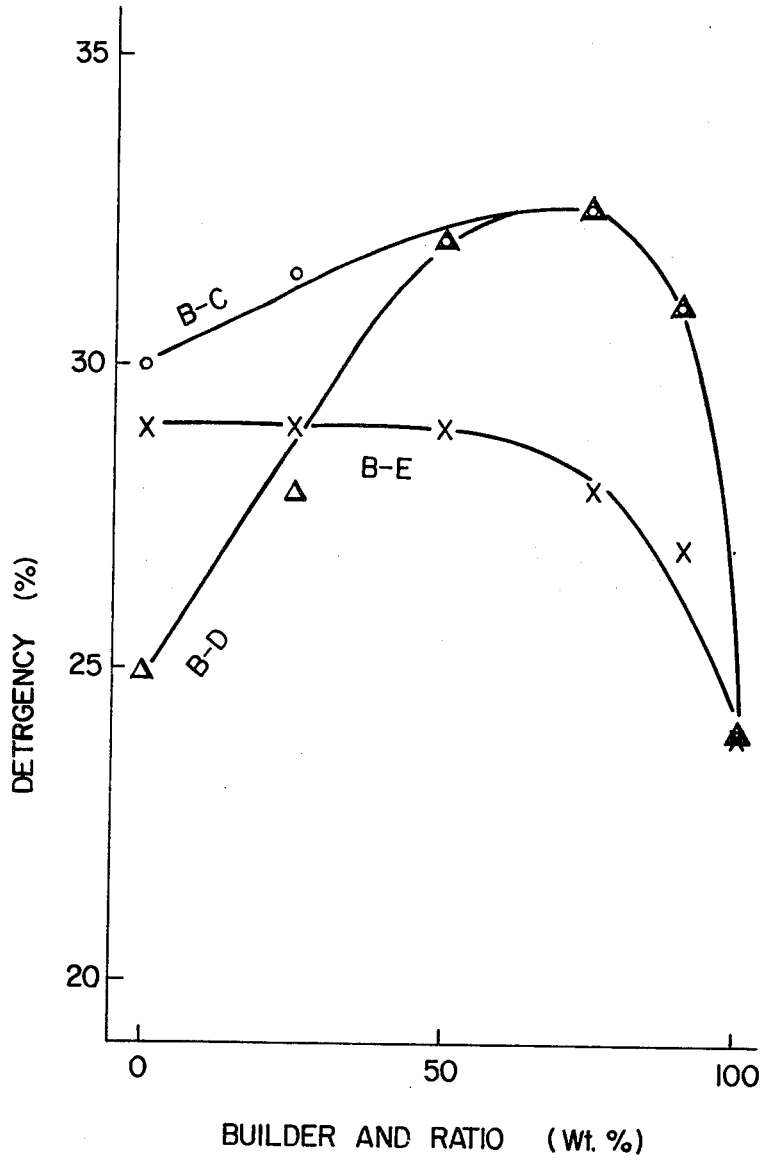

| | (parts by weight) |
|---|---|
| myristic acid | 2.4 |
| palmitic acid | 2.4 |
| oleic acid | 4.8 |
| tristearin | 4.8 |
| triolein | 4.8 |
| cholesterol | 3.2 |
| cholesteryl acetate | 1.6 |
| squwalene | 1.6 |
| liquid paraffin | 3.2 |
| cetyl alcohol | 3.2 |
| carbon black | 1.2 |
| carbon tetrachloride | 3200 |

Table 2

| | | buider and ratio (wt%) | | deter-gency (%) |
|---|---|---|---|---|
| Comparative example 1 | | no add | | 15.0 |
| Comparative example 2 | | A 100 | | 33.9 |
| | | B 100+ C | 0 (con-trol) | 24.0 |
| | | 90 | 10 | 31.0 |
| | Example 1 | 75 | 25 | 32.5 |
| | | 50 | 50 | 32.0 |
| | | 25 | 75 | 31.5 |
| the present | | 0 | 100 (con-trol) | 30.0 |
| invention | | B 100+ D | 0 (con-trol) | 24.0 |
| | | 90 | 10 | 31.0 |
| | | 75 | 25 | 32.5 |
| | Example 2 | 50 | 50 | 32.0 |
| | | 25 | 75 | 28.0 |
| | | 0 | 100 (con-trol) | 25.0 |
| Comparative example 3 | | B 100+ E | 0 | 24.0 |
| Comparative example 4 | | 90 | 10 | 27.0 |
| Comparative example 5 | | 75 | 25 | 28.0 |
| Comparative example 6 | | 50 | 50 | 29.0 |
| Comparative example 7 | | 0 | 100 | 29.0 |

EXAMPLE 3-10, REFERENTIAL EXAMPLES 1-5

65% slurry of the detergent composition shown in Table 3 was prepared and dried by means of a spray dryer. (Examples 3-7)

The detergency test of powder thus obtained was conducted using a cloth soiled like naturally by means of Terg-O-Tometer and also a naturally soiled dishcloth attached with a cotton cloth for adjusting weight was washed by means of a domestic electric washer.

In Examples 8-10, the detergent composition was used in the form of paste.

To put it more concretely, each of three pieces of dishclothes was cut in half, and one was washed with a detergent to be estimated and the other was washed with a standard detergent, and after drying they were sewed together and estimated separatedly. The marks of estimation are divided into 6 ranks of 0, 1, 2, 3, 4 and 5, and the greater number, the better washed. (in the ranks, value of ±0.5 is also used.)

The estimations were conducted by the naked eye's observation of 10 panelers and the marks of them were summed up. The estimation value is illustrated as index which is obtained by dividing the total marks of detergent to be estimated by the total marks of standard detergent and multiplying the value thus obtained by the index of standard detergent.

While there are 3 kinds of A(110), B(100) and C(90) in the indexes of standard detergent, A which shows the highest efficiency is used in the present invention, by which efficiency of the detergent composition of the present invention is relatively shown.

In the washing, city water was used and the using amount of detergent was 40g/50l. The ingredients of standard detergent used above are as follows.

| | |
|---|---|
| Sodium linear-alkylbenzene-sulfonate | 18.0 |
| Sodium tripolyphosphate | 25.0 |
| Sodium silicate | 5.0 |
| Soda ash | 3.0 |
| carboxy-methyl-celluse | 1.0 |
| neutral anhydrous Glauber's salt | 48.0 |

Table 3

| Example | | 3 | 4 | 5 | 6 | 7 | 8 | 9 | 10 |
|---|---|---|---|---|---|---|---|---|---|
| Sodium linear-alkyl-benzene sulfonate | | 18.0 | 18.0 | 12.6 | | 18.0 | 11.2 | 9.5 | 8.9 |
| Sodium higher-alcohol-sulfate | | | | 5.4 | | | | | |
| Sodium polyoxyethylene-alkylether-sulfate | | | | | | | 4.8 | 14.25 | 18.6 |
| Alkylol amide | | | | | | | 2.0 | | |
| Sodium α-olefine-sulfonate | | | | | 18.0 | | | | |
| Trisodium imidobissulfate | | 21.0 | 22.5 | 24.0 | 27.0 | 23.5 | 15.0 | 15.0 | 18.75 |
| Sodium nitrilotriacetate | | 7.0 | | 8.0 | 9.0 | 4.8 | 3.0 | 11.25 | |
| Sodium citrate | | | 7.5 | | | 3.2 | | | 3.75 |
| Sodium silicate ($Na_2O/SiO_2$ = 1/2.5) | | 6.0 | 5.0 | 8.0 | 6.5 | 8.0 | 3.0 | | |
| Soda ash | | 2.0 | 6.5 | 4.0 | 2.5 | 3.5 | | | |
| Neutral anhydrous Glauber's salt | | 34.0 | 29.0 | 26.9 | 25.5 | 27.5 | | | |
| Diethanol amine | | | | | | | | 5.0 | 5.0 |
| Carboxy-methyl-cellulose | | 1.0 | 1.0 | 1.0 | 1.0 | 1.0 | 0.5 | 0.1 | 0.1 |
| Fluorescent dyestuff, thickner, fragrance | | 0.5 | 0.5 | 0.1 | 0.5 | 0.5 | 0.3 | 0.05 | 0.05 |
| Water | | 10.0 | 10.0 | 10.0 | 10.0 | 10.0 | 60.2 | 44.85 | 44.85 |
| detergency % | the present invention | 45.3 | 47.0 | 48.0 | 47.0 | 47.3 | 45.0 | 45.3 | 44.8 |
| | referential Examples 1–5 | 47.8 | 47.2 | 47.4 | 47.4 | 47.3 | 47.5 | 47.4 | 47.4 |
| index of detergency | the present invention | 108 | 109 | 112 | 110 | 110 | 107 | 107 | 106 |
| | referential Examples 1–5 | 110 | 110 | 110 | 110 | 110 | 110 | 110 | 110 |

It is generally said that useful builders have chelating property, dispersing power, emulsifying power, alkalinity and the like.

Among the conventional builders, sodium tripolyphosphate is one of the most useful builders.

It is clear from Table 3 that the builder mixture of the present invention has excellent efficiency equal to sodium tripolyphosphate.

COMPARATIVE EXAMPLES 8–10

The detergent composition shown in Table 4 was prepared and the detergency was measured in the same manner set forth in Examples 3–7. The results are shown in Table 4.

Table 4

| | Comparative Example | | |
|---|---|---|---|
| | 8 | 9 | 10 |
| Sodium linear-alkylbenzene-sulfonate | 18.0 | 18.0 | 18.0 |
| Sodium citrate | 15.0 | 30.0 | |
| Tetrasodium ethylene-diamine-tetraacetate | 15.0 | | 30.0 |
| Soda ash | 8.0 | 10.0 | 8.0 |
| Sodium silicate | 6.0 | 6.0 | 6.0 |
| Neutrol anhydrous Glauber's salt | 26.5 | 24.5 | 26.5 |
| Carboxy-methyl-cellulose | 1.0 | 1.0 | 1.0 |
| Fluorescent dyestuff, fragrance | 0.5 | 0.5 | 0.5 |

Table 4-continued

| | Comparative Example | | |
|---|---|---|---|
| | 8 | 9 | 10 |
| Water | 10.0 | 10.0 | 10.0 |
| Detergency of naturally like soiled cloth (%)* | 33.5 | 32.1 | 36.1 |
| Detergency of naturally soiled cloth (index) | 102 | 102 | 103 |

*Detergency of naturally like soiled cloth in case of using standard detergent was 47.5%.

EXAMPLE 11

Four kinds of toxicity tests were conducted about trisodium imidobissulfate which is a main component of builder in the detergent composition of the present invention.

1. Testing methods

Sub-acute oral toxicity test: After prescribing forcibly 1.8 g/kg (a limit amount to prescribe for a long period of time) one time a day, to a rat for one month, observation of the appearance, measurement of weight, measurement of the blood composition, chemical analysis of the blood plasma, measurement of weight of the internal organs and histological reference were conducted.

Skin irritation test : Skin irritation test to rabit was conducted in accordance with the improved Draze method (Federal Register No. 37,27635, 1972).

A patch coated with an aqueous solution of 7% of the sample was applied on the skin of back and the primary irritation rate was calculated observing for 3 days.

Hemolytic action : Hemolytic action after 1 hour to the blood of rabit was measured.

Fish toxicity : TLm value (medeam tolerance limit) to killifish was measured in accordance with JIS K0102.

2. Test Results

Sub-acute oral otxicity est : As the result of observation of the appearance, no remarkable change was observed except a little prevention of an increase in weight of a male. As the result of the biochemical tests, no change was observed except a little decrease in Ca and a little increase in inorganic P of a male.

As the result of measurement of weight of the internal organ and of the pathological tests, no change was observed except a little increase in weight of the kidney.

After all, after prescribing the sample for one month, no specific trouble was observed.

Skin irritation test : The primary irritation rate was 0.17 nearly equal to 0.08 which was the primary irritation rate at a part applied with distilled water. The irritation action was in the rank of "very mild".

Hemolytic action : Blood was partially dissolved at 0.05% but no blood was dissolved at 0.025%.

Fish toxicity : TLm (24 hours) was 2500 ppm and TLm (48 hours) was 1450 ppm, each of which means very low toxicity.

It is apparent from the above test results that trisodium imidobissulfate is a very low toxic substance as far as using a usual amount of it.

What is claimed is:

1. A detergent composition consisting essentially of (1) an anionic surface active agent selected from the group consisting of sodium linear alkylbenzene sulfonate, sodium higher alcohol sulfate, sodium higher alcohol ethoxy sulfate, sodium olefin sulfonate and their corresponding potassium and ammonium salts; (2) an imidobissulfate of the general formula $(MSO_3)_2NM$ in which M is a cation selected from the group consisting of sodium, potassium and ammonium; and (3) at least one compound selected from the group consisting of sodium nitrilotriacetate and sodium citrate; the amount of (1) being 25–65 parts by weight, the amount of (2) being 25–65 parts by weight and the amount of (3) being 5–35 parts by weight, said amounts being based on 100 parts by weight of (1), (2) and (3).

2. Detergent composition according to claim 1, in which M is sodium ion.

3. Detergent composition according to claim 1, in which the compound (3) selected from the group consisting of sodium nitrilotriacetate and sodium citrate is 10–50% by weight based on the total weight of the compound and the imidobissulfate.

4. A detergent composition consisting essentially of (1) an anionic surface active agent selected from the group consisting of sodium linear alkylbenzene sulfonate, sodium higher alcohol sulfate, sodium higher alcohol ethoxy sulfate, sodium olefin sulfonate and their corresponding potassium and ammonium salts; (2) an imidobissulfate of the general formula $(MSO_3)_2NM$ in which M is a cation selected from the group consisting of sodium, potassium and ammonium; and (3) sodium citrate, the amount of (1) being 25–65 parts by weight, the amount of (2) being 25–65 parts by weight and the amount of (3) being 10–50% by weight based on the total weight of the citrate compound and the imidobissulfate, said amounts being based on 100 parts by weight of (1), (2) and (3).

5. A detergent composition consisting essentially of (1) an anionic surface active agent selected from the group consisting of sodium linear alkylbenzene sulfonate, sodium higher alcohol sulfate, sodium higher alcohol ethoxy sulfate, sodium olefin sulfonate and their corresponding potassium and ammonium salts; (2) an imidobissulfate of the general formula $(MSO_3)_2NM$ in which M is a cation selected from the group consisting of sodium, potassium and ammonium; and (3) sodium nitrilotriacetate; the amount of (1) being 25–65 parts by weight, the amount of (2) being 25–65 parts by weight and the amount of (3) being 10–50% by weight based on the total weight of the nitrilotriacetate compound and the imidobissulfate, said amounts being based on 100 parts by weight of (1), (2) and (3).

* * * * *

UNITED STATES PATENT AND TRADEMARK OFFICE

CERTIFICATE OF CORRECTION

PATENT NO. : 4,203,873

DATED : May 20, 1980

INVENTOR(S) : HIROSHI SUZUKI ET AL

It is certified that error appears in the above-identified patent and that said Letters Patent are hereby corrected as shown below:

On the title page, under the subheading "Assignee" and after "Agency of Industrial Science & Technology, Tokyo, Japan", please add --Nitto Chemical Industry Co., Ltd., Tokyo, Japan --.

Signed and Sealed this

*Fifth* Day of *August 1980*

[SEAL]

*Attest:*

SIDNEY A. DIAMOND

*Attesting Officer*

*Commissioner of Patents and Trademarks*